US009339118B2

(12) United States Patent
Gubitosi et al.

(10) Patent No.: US 9,339,118 B2
(45) Date of Patent: May 17, 2016

(54) INFANT SUPPORT WITH STORAGE COMPARTMENT

(71) Applicant: Mattel, Inc., El Segundo, CA (US)

(72) Inventors: Domenic T. Gubitosi, East Aurora, NY (US); Kurt J. Huntsberger, Arcade, NY (US); Maarten Van Huystee, Lancaster, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/253,113

(22) Filed: Apr. 15, 2014

(65) Prior Publication Data

US 2015/0061329 A1 Mar. 5, 2015

Related U.S. Application Data

(63) Continuation of application No. PCT/US2013/057221, filed on Aug. 29, 2013.

(51) Int. Cl.
*A47D 1/00* (2006.01)
*A47D 1/02* (2006.01)

(52) U.S. Cl.
CPC . *A47D 1/008* (2013.01); *A47D 1/02* (2013.01)

(58) Field of Classification Search
CPC ..... A47D 1/008; A47D 1/02
USPC ..... 297/174 R, 188.04, 188.07, 188.05, 297/411.32, 113, 445.1, 51
See application file for complete search history.

(56) References Cited

U.S. PATENT DOCUMENTS 3,094,354 A * 6/1963 Bernier ..... 297/112
3,232,662 A 2/1966 Graves
3,761,124 A * 9/1973 Weik et al. ..... 297/112
5,116,099 A * 5/1992 Kwasnik et al. ..... 297/188.15
5,303,976 A * 4/1994 Nobile et al. ..... 297/146
5,628,543 A * 5/1997 Filipovich et al. ..... 297/113
5,658,047 A * 8/1997 Ratza et al. ..... 297/378.14
6,017,085 A 1/2000 LaCroix et al.
6,059,358 A * 5/2000 Demick et al. ..... 297/188.04

(Continued)

FOREIGN PATENT DOCUMENTS

WO 2012048205 A2 4/2012

OTHER PUBLICATIONS

International Search Report and Written Opinion from PCT/US2013/057221, dated May 23, 2014.

*Primary Examiner* — Timothy J Brindley
(74) *Attorney, Agent, or Firm* — Edell, Shapiro & Finnan, LLC

(57) ABSTRACT

An infant support includes a base and a backrest. The base is configured to rest upon a support surface and support an infant on the infant support. The base further includes a seat region and two arm portions. The backrest is pivotally coupled to the base between a storage configuration and an upright configuration. The backrest includes a front portion and a rear portion coupled together. The rear portion is configured to pivot between a closed position, in which the rear portion forms an interior cavity with the front portion, and an open position, where the rear portion is pivoted away from the front portion. The interior cavity is configured to receive and store napkins, wipes, or towels. The rear portion further includes an aperture and an operable door disposed proximate to the aperture. When the door is opened, the aperture provides access to the interior cavity for removing napkins, wipes, or towels from the infant support.

11 Claims, 6 Drawing Sheets

(56) References Cited

U.S. PATENT DOCUMENTS

| | | | | |
|---|---|---|---|---|
| 6,082,815 | A * | 7/2000 | Xiromeritis et al. | 297/124 |
| 6,089,653 | A | 7/2000 | Hotaling et al. | |
| 6,199,948 | B1 * | 3/2001 | Bush et al. | 297/217.3 |
| 6,220,660 | B1 * | 4/2001 | Bedro et al. | 297/188.04 |
| 6,702,375 | B1 * | 3/2004 | Laskowski et al. | 297/188.07 |
| 6,773,064 | B2 | 8/2004 | Treen et al. | |
| 6,832,813 | B2 | 12/2004 | Tomas et al. | |
| 7,104,603 | B2 | 9/2006 | Keegan et al. | |
| 7,114,772 | B2 * | 10/2006 | Kobayashi et al. | 297/188.04 |
| 7,121,620 | B1 * | 10/2006 | Fang | 297/51 |
| 7,328,941 | B2 | 2/2008 | Asbach et al. | |
| 7,387,337 | B2 | 6/2008 | Keegan et al. | |
| 7,523,985 | B2 * | 4/2009 | Bhatia et al. | 297/188.04 |
| 7,611,183 | B2 * | 11/2009 | Burkey et al. | 296/37.15 |
| 7,871,125 | B2 | 1/2011 | Asbach et al. | |
| 8,091,965 | B2 | 1/2012 | Flannery et al. | |
| 8,226,161 | B2 | 7/2012 | Fiore, Jr. et al. | |
| 8,267,473 | B2 | 9/2012 | Flannery et al. | |
| 8,973,985 | B2 * | 3/2015 | Arakawa et al. | 297/112 |
| 2002/0140246 | A1 * | 10/2002 | Worrell et al. | 296/37.8 |
| 2003/0102702 | A1 | 6/2003 | Daley et al. | |
| 2004/0084938 | A1 | 5/2004 | Tomas et al. | |
| 2004/0124675 | A1 * | 7/2004 | Ingram et al. | 297/146 |
| 2005/0200169 | A1 | 9/2005 | Tipton | |
| 2006/0071497 | A1 * | 4/2006 | Radu et al. | 296/24.34 |
| 2006/0085940 | A1 * | 4/2006 | Chernoff | 15/313 |
| 2008/0252111 | A1 * | 10/2008 | Rothkop et al. | 297/188.04 |
| 2009/0160227 | A1 * | 6/2009 | Crombez et al. | 297/113 |
| 2010/0244503 | A1 | 9/2010 | Fiore, Jr. et al. | |
| 2010/0244518 | A1 | 9/2010 | Fiore, Jr. et al. | |
| 2011/0169307 | A1 | 7/2011 | Asbach et al. | |
| 2012/0061999 | A1 | 3/2012 | Soriano et al. | |
| 2012/0198630 | A1 | 8/2012 | Babikian et al. | |
| 2012/0292955 | A1 * | 11/2012 | van Zyl et al. | 297/188.04 |
| 2013/0113241 | A1 * | 5/2013 | Tsuchiya et al. | 297/188.04 |
| 2014/0042781 | A1 * | 2/2014 | Reeves | 297/163 |
| 2014/0197657 | A1 * | 7/2014 | Gillis et al. | 296/37.8 |

* cited by examiner

INFANT SUPPORT WITH STORAGE COMPARTMENT

CROSS-REFERENCE TO RELATED APPLICATION

The present application is a national stage application of International Patent Application PCT/US2013/057221, filed Aug. 29, 2013, entitled "Infant Support with Storage Compartment," the entire disclosure of which is incorporated by reference herein in its entirety.

FIELD OF THE INVENTION

The present invention relates to an infant support. More specifically, the present invention is an infant support with a storage compartment within the infant support.

BACKGROUND OF THE INVENTION

Infants and children are often not tall enough to reach conventional tables while seated in conventional chairs. Accordingly, high chairs, booster seats, and other types of infant supports have been developed, which provide a suitable feeding environment for infants and small children. Some high chairs and booster seats include tray members that may be used to support food or other items in close proximity to the infant or child.

Conventional high chairs and booster seats that include tray members, however, do not include storage compartments for storing wipes, napkins, or towels. Thus, when food and/or other items create a mess on the tray or on a child, the parent or caregiver may feel a need to walk away from the child within the high chair or booster seat to get wipes, napkins, or towels for cleaning up the mess. For example, after an infant or a child has finished eating a meal, a parent or a caregiver may wish to wipe down the tray or the face of the child once a mess has been created. If the parent or caregiver leaves the child, the child may continue to make a mess with the food. By including a storage compartment for wipes, napkins, or towels, within the high chair or booster the parent or caregiver can clean up a mess before it becomes worse or before it begins to stain.

Thus, a need exists for a high chair, a booster seat, or other type of infant or child support or receiving device that includes a storage compartment configured to store napkins, wipes, or towels for cleaning the tray of the infant support or the infant. Further, a need exists for such a storage compartment that forms an airtight seal for storing wipes that are pre-moistened. Finally, the storage compartment should be easily accessible by a parent or caregiver, but not a child within the seat of the infant support.

SUMMARY OF THE INVENTION

According to one exemplary embodiment, an infant support in accordance with the present invention includes a base defining a supporting surface, a first member coupled to the base, and a second member movably coupled to the base. The first member and the second member each contain a top and a bottom. The second member being movably coupled to the base about the bottom of the second member. Moreover, the second member is movable between a first position and a second position. In the first position, the top of the second member is coupled to the top of the first member, and the first member and the second member define a cavity. In the second position, the top of the second member is uncoupled from the first member. In addition, the infant support includes an opening disposed on the second member, which provides access to the cavity when the second member is in the first position. Furthermore, the infant support includes a door movably coupled to the second member at a location proximate the opening. The door is repositionable between a closed position and an open position. In the closed position, the door covers the opening. In the open position, the door does not cover the opening and provides access to the cavity.

BRIEF DESCRIPTION OF THE DRAWINGS

Like reference numerals have been used to identify like elements throughout this disclosure.

DETAILED DESCRIPTION OF THE INVENTION

Figure 1:
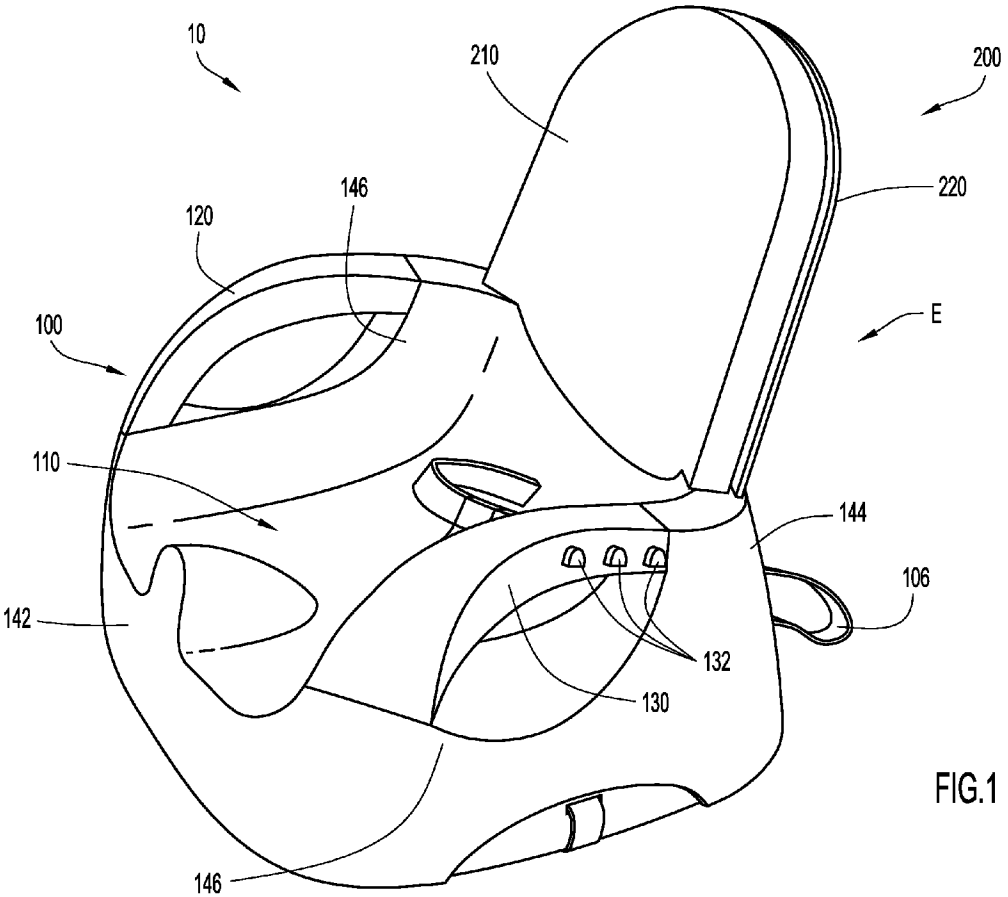
FIG. 1 illustrates a perspective view of an exemplary embodiment of an infant support according to the present invention.

Referring to FIG. 1, a perspective view of an exemplary embodiment of the infant support 10 in accordance with the present invention is illustrated. According to this embodiment, the infant support 10 includes a base 100 and a backrest 200. The base 100 includes a front 142, a rear 144, and two sides 146, which define a seat region 110 configured to receive and support a child in a seated position. The backrest 200 extends substantially vertically from the rear 144 of the base 100. Furthermore, according to this embodiment, the backrest 200 includes a front portion 210 and a rear portion 220. The backrest 200 is pivotally coupled to the rear 144 of the base 100 and may be placed in an upright or use configuration E (illustrated in FIG. 1) or in a parallel, collapsed, or storage configuration F (not shown). When in the storage configuration F, the backrest 200 extends substantially horizontally from the rear 144 of the base 100 towards the front 142 of the base 100 over the seat region 110. The infant support 10 also includes a restraint strap system 106 for safely retaining and restraining a child in the seat region 110.

Furthermore, on each of the two sides 146 are arm portions 120, 130 integrally or unitarily formed with the sides 146 of the base 100. The arm portions 120, 130 extend from the two sides 146. In an alternative embodiment, the arm portions 120, 130 are not integrally or unitarily formed with the sides 146 of the base 100. Rather the arm portions 120, 130 are pivotally coupled, fixedly coupled, or otherwise coupled to the sides 146 of the base 100. As illustrated, the second arm portion 130 includes three projections 132. Similarly, the first arm portion 120 includes three projections 122 (not shown). These projections 122 and 132 are positioned and configured on the arm portions 120, 130 for attaching accessories, such as a tray, to the infant support 10.

Figure 2:
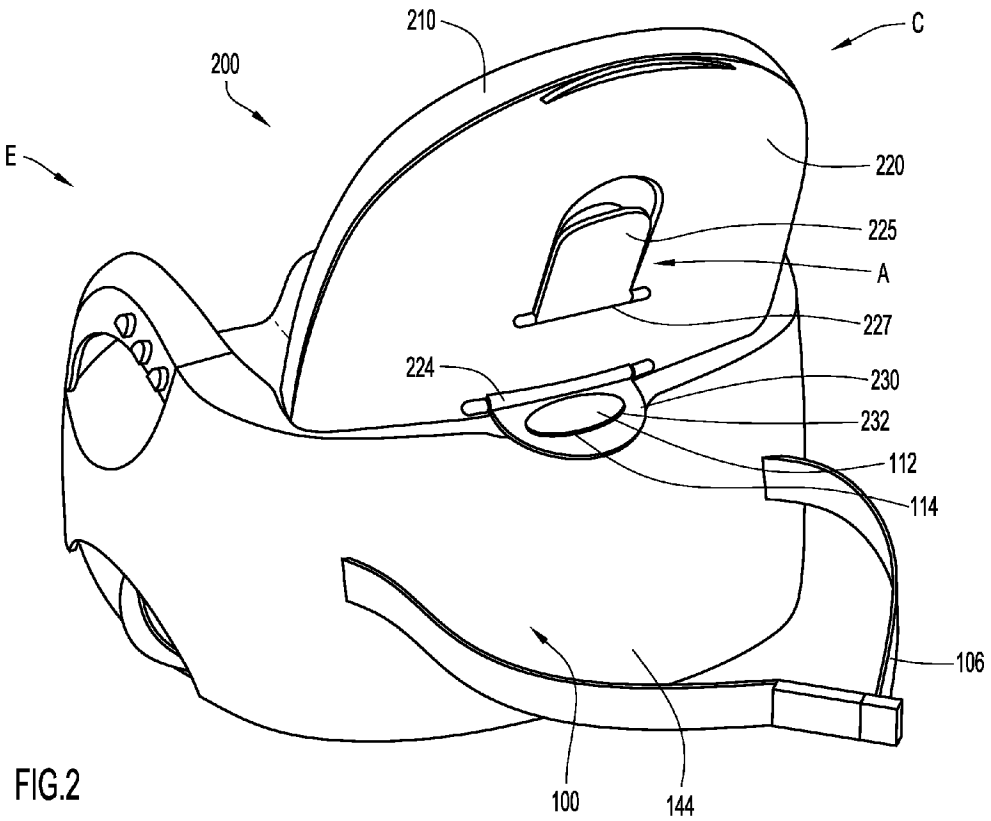
FIG. 2 illustrates a rear view of the embodiment of the infant support illustrated in FIG. 1.

Referring to FIG. 2, illustrated is a rear view of the infant support 10. The rear 144 of the base 100 includes a locking portion 112, which includes a projection 114. The projection 114 extends from the rear portion 144 of the base 100. Additionally, extending rearwardly from the backrest 200 is a locking flange 230. The flange 230 is coupled to and extends from the backrest 200 at hinge 224. The flange 230 is configured to interact with the locking portion 112. The locking flange 230 further defines an opening 232 that is shaped and sized to receive the projection 114 of the locking portion 112. The opening 232 of the flange 230 receives the projection 114 of the locking portion 112 when the backrest 200 is in the upright or use configuration E. The flange 230 may be bent or flexed such that the projection 114 is removed from the opening 232 to allow the backrest 200 to be pivoted with respect to the base 100 to convert the backrest 200 from its upright configuration E to its storage configuration F (not shown). In an alternative embodiment, the backrest 200 and/or the base 100 include another mechanism for securing the backrest 200 in its upright configuration E. For example, in one embodiment, a pair of straps with a snap or buckle system is used to secure the backrest 200 in its upright configuration E. In another embodiment, the backrest 200 does not lock into its upright configuration E. In yet another embodiment, the backrest 200 may not be reconfigurable.

Figure 3:
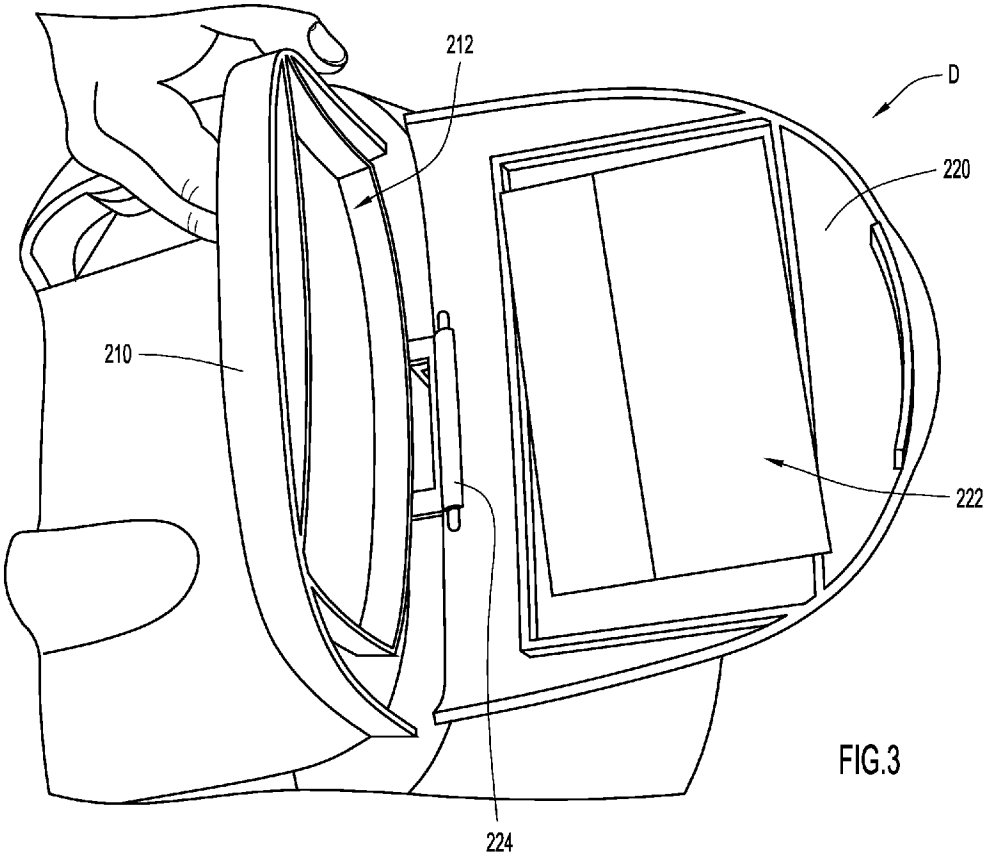
FIG. 3 illustrates a top view of the backrest of the embodiment illustrated in FIG. 1, where the backrest is in the open position.

Referring to FIGS. 2 and 3, illustrated is the backrest 200 with the front portion 210 and the rear portion 220 being configured between a closed position C and an open position D. Illustrated in FIG. 2, the front portion 210 and the rear portion 220 are coupled together in the closed position C. As illustrated, the rear portion 220 is coupled to the front portion 210 so that the rear portion 220 rests flush against the front portion 210. The rear portion 220 is configured to pivot independently of the front portion 210 to the position illustrated in FIG. 3, which illustrates the backrest 200 in the open position D. The rear portion 220 is configured to pivot away from the front portion 210 about the hinge 224, which is the same hinge 224 to which the flange 230 is connected. As illustrated in FIG. 3, the front portion 210 includes an interior cavity 212, and the rear portion 220 includes an interior cavity 222. When the backrest is in the closed position C, the interior cavities 212, 222 are aligned with one another creating one large cavity there between. The cavities 212, 222 are configured to receive napkins, wipes, towels, or other items. The interior cavity 212 of the front portion 210 and the interior cavity 222 of the rear portion 220 form a seal with each other when the backrest 200 is in the closed position C. In some embodiments, the seal formed by the cavities 212, 222 may be an airtight seal. By forming an airtight seal, the cavities 212, 222 are capable of storing pre-moistened wipes for a prolonged period of time without the pre-moistened wipes losing their moisture and drying out.

Figure 4:
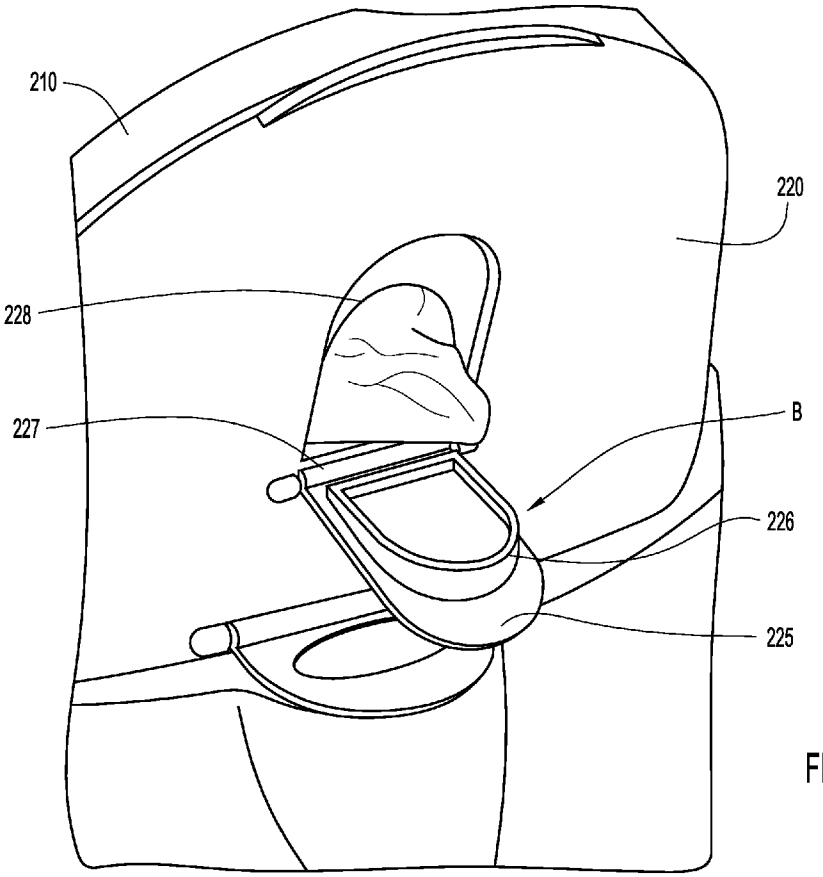
FIG. 4 illustrates a view of the door on the backrest of the embodiment illustrated in FIG. 2, the door being in the open position.

Referring to FIGS. 2 and 4, illustrated is a door 225 being repositioned between a closed position A and an open position B. As illustrated in FIGS. 2 and 4, the door 225 is hingedly coupled to the rear portion 220 of the backrest 200. The door 225 is configured to rotate about hinge 227 between the closed position A, illustrated in FIG. 2 and the open position B, illustrated in FIG. 4. Furthermore, FIG. 4 illustrates that the rear portion 220 further includes an aperture 228 positioned proximate to the door 225. The aperture 228 provides access into the cavities 212, 222 that are illustrated in FIG. 3. This aperture 228 is configured to enable a user to easily remove one napkin, wipe, or towel at a time from within the cavities 212, 222 when they are needed without repositioning the rear portion 220 from the closed position C to the open position D. As illustrated by FIG. 4, when the door 225 is in the open position B, a user has access to the aperture 228 and the cavities 212, 222. Conversely, as illustrated in FIG. 2, when the door 225 is in the closed position A, a user does not have access to the aperture 228 and the cavities 212, 222. Furthermore, the door 225 contains an extension 226. The extension 226 is sized and shaped similar to that of the aperture 228 of the rear portion 220. When the door 225 is in the closed position A, the extension 226 is frictionally fit within the aperture 228 and may create a seal with the aperture 228. This seal may be airtight, allowing any pre-moistened wipes stored in the cavities 212, 222 to retain their moisture. In addition, because the extension 226 is frictionally fit within the aperture 228, the door 225 is capable of remaining in the closed position A until a user intentionally rotates the door 225 to the open position B. In another embodiment, the door 225 may include a tab that engages and end of the aperture 228 to lock the door in the closed position A.

Figure 5:
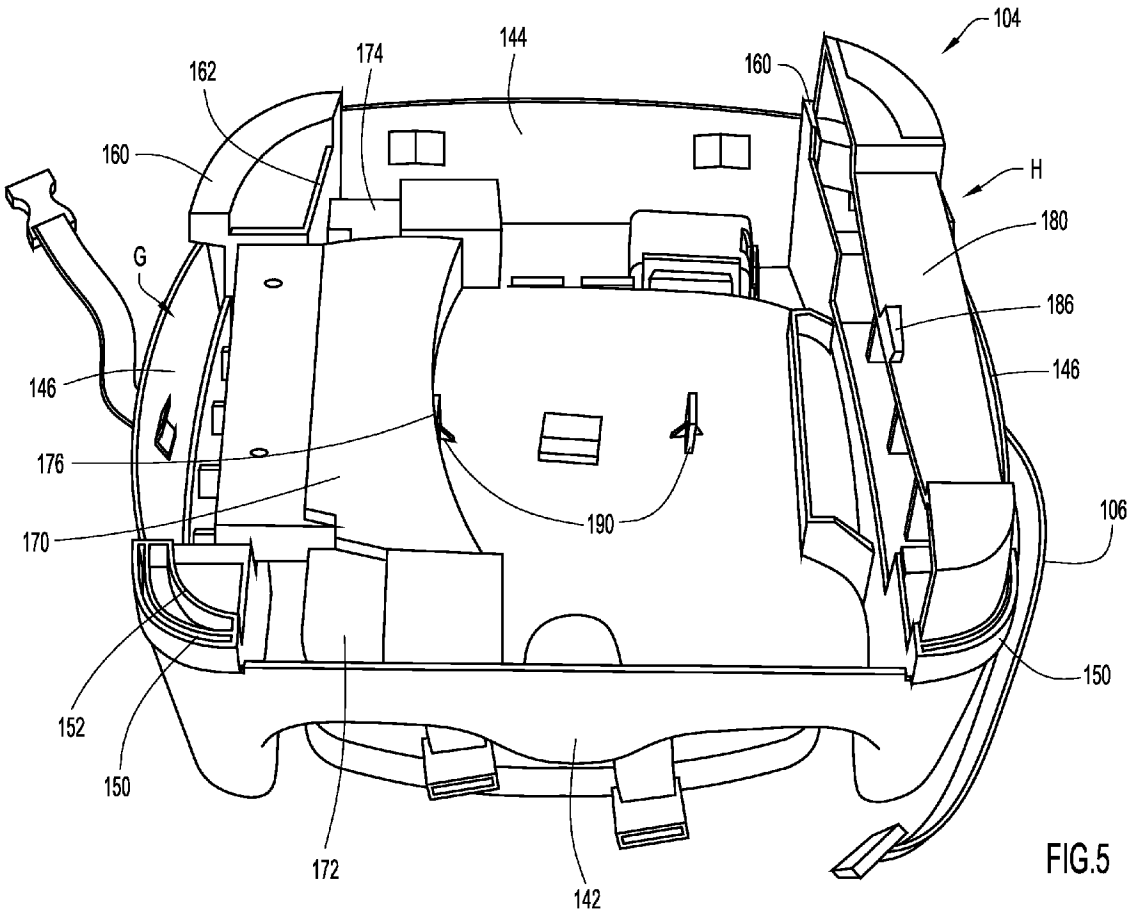
FIG. 5 illustrates a bottom view of the infant support illustrated in FIG. 1.

Referring to FIG. 5, illustrated is the bottom 104 of the base 100. The bottom 104 of the base 100 includes a pair of front feet 150 coupled to the bottom 104 of the base 100 proximate to the front 142 of the base 100. Furthermore, the bottom 104 of the base includes a pair of rear feet 160 coupled to the bottom 104 of the base 100 proximate to the rear 144 of the base 100. The front feet 150 each include an aperture 152, while the rear feet 160 each include an aperture 162. Moreover, repositionably coupled to the bottom 104 of the base 100 are first leg extension 170 and second leg extension 180. The first leg extension 170 is repositionably coupled to the bottom 104 of the base 100 proximate to one the sides 146 of the base 100. In addition, the first leg extension 170 is positioned between one front foot 150 and one rear foot 160. The first leg extension 170 includes a front engagement member 172, a rear engagement member 174, and a locking projection 176. The second leg extension 180 is repositionably coupled to the bottom 104 of the base 100 proximate to the other of the sides 146 of the base 100. The second leg extension 180 is also positioned between one front foot 150 and one rear foot 160. In addition, the second leg extension 180 includes a front engagement member 182 (not visible), a rear engagement member 184 (not visible), and a locking projection 186.

Continuing with FIG. 5, the leg extensions 170, 180 are repositionable between a storage configuration G and a deployed configuration H. As illustrated in FIG. 5, the first leg extension 170 is in the storage configuration G and the second leg extension 180 is in the deployed configuration H. When the leg extensions 170, 180 are reconfigured to the deployed configuration H, the front engagement members 172, 182 are inserted into the apertures 152 of the front feet 150 while the rear engagement members 174, 184 are inserted into the apertures 162 of the rear feet 160. The engagement members 172, 174, 182, 184 are configured to frictionally fit within the apertures 152, 162 of the feet 150, 160, securing the leg extensions 170, 180 to the feet 150, 160. When the leg extensions 170, 180 are in the deployed configuration H, the leg extensions 170, 180 are configured to extend downwardly from the legs 150, 160 and support the infant support 10 on a support surface. The leg extensions 170, 180 provide additional height for the infant support 10 when the additional height is needed.

Moreover, when the leg extensions 170, 180 are in the storage configuration G, the leg extensions 170, 180 are folded into the base 100 so that the leg extensions 170, 180 do not extend past the feet 150, 160, so the feet 150, 160 support the infant support 10 on a support surface. When in the storage configuration G, the locking projections 176, 186 of the leg extensions 170, 180 are configured to interact with retaining tabs 190 to prevent the leg extensions 170, 180 from pivoting out of the storage configuration G. The retaining tabs 190 may be bent or flexed such that the locking projections 176, 186 are disengaged from the retaining tabs 190 to allow the leg extensions 170, 180 to be pivoted from the storage configuration G to the deployed configuration H.

Figure 6:
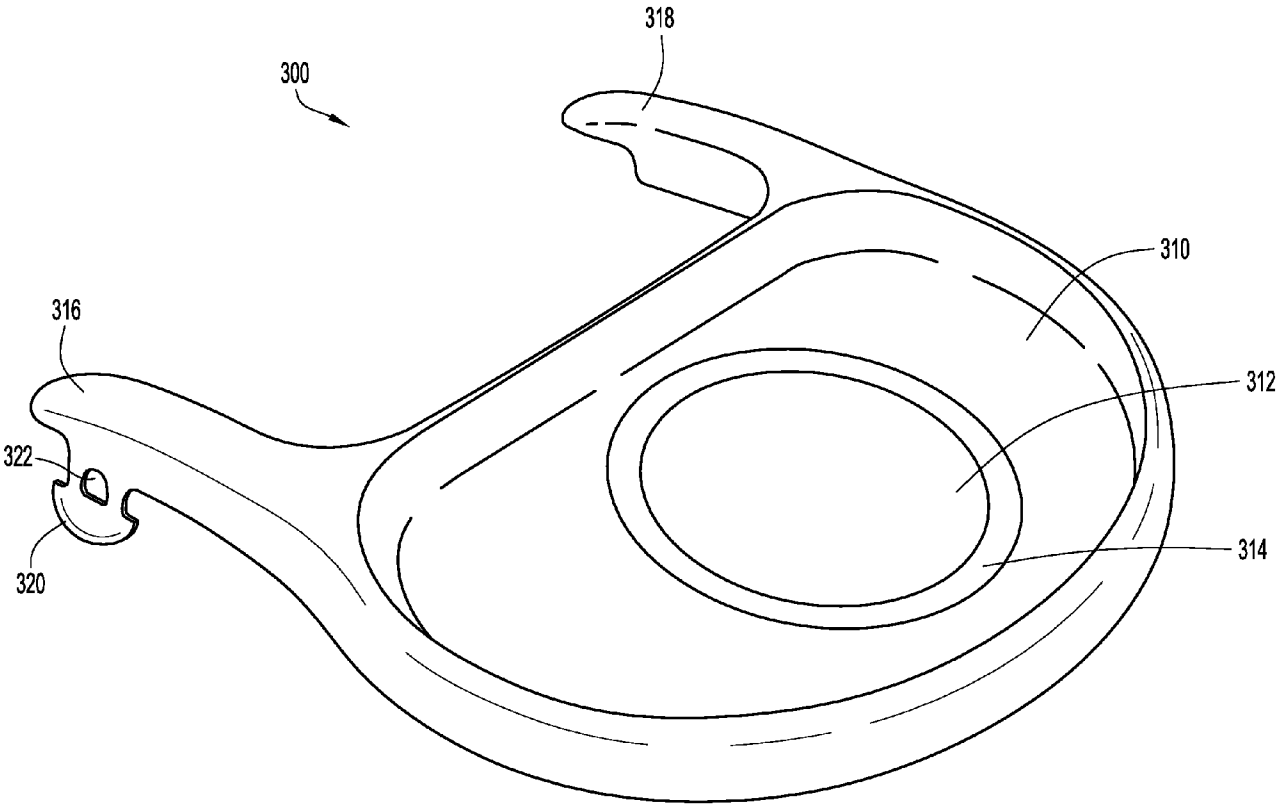
FIG. 6 illustrates a perspective view of an accessory tray that is coupleable to the infant support illustrated in FIG. 1.

Referring to FIG. 6, illustrated is a perspective view of a removable tray 300 of the infant support 10. The removable tray 300 is configured to be removably attached to the arms 120, 130 of the base 100. As illustrated, the tray 300 includes a tray surface 310, which includes a placement region 312. In this embodiment, the placement region 312 is circular and configured to receive the bottom of a plate, bowl, or other type of dishware. The placement region 312 may further include an overmold material 314 along the perimeter of the placement region 312. The overmold material 314 provides additional frictional contact to dishware placed on the tray surface 310, preventing the dishware on the tray surface 310 from sliding on the tray surface 310.

The tray 300 further includes a first member 316 and a second member 318. The first member 316 includes a first coupling member 320, and the second member 318 includes second coupling member 330 (not shown). Each of the coupling members 320, 330 include apertures 322, 332 (not shown) configured to receive one of the projections 122, 132 of the arms 120, 130 to removably couple the tray 300 to the base 100. Specifically, the first coupling member 320 is configured to be removably coupled to the first arm portion 120 and the second coupling member 330 is configured to be removably coupled to the second arm portion 130. The coupling members 320, 330 are resilient and configured to be bent or otherwise flexed by a user to remove the projections 122, 132 of the arm portions 120, 130 from the openings 322, 332. As illustrated in FIG. 1, the second arm portion 130 includes three projections 132. Similarly, but not illustrated, the first arm portion 120 includes three projections 122. Thus, the tray 300 may be removably coupled to the arm portions 120, 130 in one of three different horizontal positions to allow the infant support 10 to be used by different sized children or infants.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. An infant support comprising:

a base defining an infant supporting surface;

a first member coupled to the base, the first member having a top and a bottom;

a second member with a top and a bottom, the second member being movably coupled to the base about the bottom of the second member, the second member being movable between a first position, where the top of the second member is coupled to the top of the first member, and a second position, where the top of the second member is uncoupled from the first member and the second member extends rearwardly with respect to the infant supporting surface, the first member and the second member defining a cavity when the second member is in the first position;

an opening disposed on the second member, the opening providing access to the cavity when the second member is in the first position; and a door hingedly coupled to the second member proximate to the opening.

2. The infant support of claim 1, further comprising a first arm portion and a second arm portion disposed on the base.

3. The infant support of claim 1, further comprising a first leg extension coupled to the base and reconfigurable between a deployed configuration and a storage configuration.

4. The infant support of claim 3, further comprising a second leg extension coupled to the base and reconfigurable between a deployed configuration and a storage configuration, the second leg extension being reconfigurable independent from the first leg extension.

5. The infant support of claim 1, wherein the door is repositionable between a closed position, where the door covers the opening, and an open position, where the opening is uncovered.

6. An infant support comprising:

a base with a front, a back opposite the front, a first side, and a second side opposite the first side, the front, back, first side, and second side defining an infant supporting surface; and a backrest rotatably coupled to the back of the base, the backrest being configured to rotate between a storage configuration and an upright configuration, the backrest comprising:

a front portion having an inner surface and outer surface, a rear portion having an inner surface, an outer surface, and an opening disposed on the outer surface, the rear portion being rotatably coupled to the front portion between a closed position, where the inner surface of the rear portion rests flush against the inner surface of the front portion, and an open position, where the inner surface of the rear portion is positioned away from the inner surface of the front portion and the rear portion extends rearwardly with respect to the infant supporting surface when the backrest is in the upright configuration, wherein the inner surface of the front portion and inner surface of the rear portion define a cavity when the rear portion is in the closed position, the opening providing access to the cavity, and a door hingedly coupled to the rear portion proximate to the opening.

7. The infant support of claim 6, further comprising a first arm portion disposed on the first side of the base and a second arm portion disposed on the second side of the base.

8. The infant support of claim 7, further comprising a tray removably coupleable to the first arm portion and second arm portion.

9. The infant support of claim 6, further comprising a first leg extension coupled to the base and reconfigurable between a deployed configuration and a storage configuration.

10. The infant support of claim 9, further comprising a second leg extension coupled to the base and reconfigurable between a deployed configuration and a storage configuration, the second leg extension being reconfigurable independent from the first leg extension.

11. The infant support of claim 6, wherein the door is repositionable between a closed position, where the door covers the opening, and an open position, where the opening is uncovered.

* * * * *